US005551614A

United States Patent [19]

Ham

[11] Patent Number: 5,551,614

[45] Date of Patent: Sep. 3, 1996

[54] SHOULDER PAD FOR A LUGGAGE CASE SHOULDER STRAP

[75] Inventor: SooJung Ham, Providence, R.I.

[73] Assignee: Samsonite Corporation, Denver, Colo.

[21] Appl. No.: 397,526

[22] Filed: Mar. 2, 1995

[51] Int. Cl.[6] ..... A45F 3/12

[52] U.S. Cl. ..... 224/264; 224/617; 2/268; 2/2

[58] Field of Search ..... 224/264, 202, 224/209, 907; 2/267, 268; 450/86; 294/149, 150, 151; 297/482; 128/99.1, 105.1, 106.1, 107.1

[56] References Cited

U.S. PATENT DOCUMENTS

| | | | |
|---|---|---|---|
| 2,441,785 | 5/1948 | Zacks | 2/268 |
| 2,497,808 | 2/1950 | Zacks | 2/268 |
| 2,654,887 | 10/1953 | Hookstratten | 224/264 |
| 2,808,973 | 10/1957 | Gobble | 224/264 |
| 3,154,787 | 11/1964 | Newman | 2/268 |
| 3,306,662 | 2/1967 | Finnigan | 297/482 |
| 5,018,652 | 5/1991 | Holtzclaw, Jr. | 224/264 |
| 5,388,743 | 2/1995 | Silagy | 224/264 |

FOREIGN PATENT DOCUMENTS

| | | | |
|---|---|---|---|
| 476793 | 6/1915 | France | 224/160 |
| 2824138 | 12/1979 | Germany | 297/482 |

*Primary Examiner*—Henry J. Recla
*Assistant Examiner*—Gregory M. Vidovich
*Attorney, Agent, or Firm*—Gregory W. O'Connor; Rod D. Baker

[57] ABSTRACT

Shoulder pads to provide a comfortable cradle for a shoulder strap for carrying the luggage case includes a foam pad and an elastic webbing firmly attached to this foam pad. The elastic webbing embraces the shoulder strap, yet stretches adequately to permit the shoulder pad to slide over buckles, snap hook pivots, etc. normally forming a part of the shoulder strap assembly.

6 Claims, 1 Drawing Sheet

SHOULDER PAD FOR A LUGGAGE CASE SHOULDER STRAP

BACKGROUND OF THE INVENTION

Generally, luggage cases especially soft side luggage cases (luggage pieces made up of stitched cloth panels to define a main packing compartment), have typically two carrying methods: a handle grip and a shoulder strap fastened to the outside of the case. The shoulder strap is usually a length of webbing with a loop, a buckle, and other fittings to permit the webbing to be removed from the case. Also, these fittings permit the length of the loop to be adjusted so that the case can be carried at a convenient distance below the user's shoulder.

Except for in very small cases where the weight of the case and its contents are not a factor, these shoulder straps usually have a shoulder pad to reduce the contact pressure caused by the shoulder strap over the shoulder of the user. These pads fall into two categories. The first, and most typical, is a molded rubber construction with a thick, generally rectangular, shoulder contacting portion and a smaller portion comprising one or two integrally formed loops through which the shoulder strap passes. The second type is similar to the shoulder pad used for golf bags and is a stitched assembly permanently attached to the shoulder strap about equally distant from the opposite ends of the shoulder strap. This has a body of flexible vinyl or fabric with a non-slip shoulder contacting layer stitched to one face. Both of these shoulder pads are either attached permanently to a particular point on the strap or are slipped on the strap before the fittings, such as buckles, swivel hooks, etc. are attached to the ends of the strap. This places a restriction on the manufacturing of these straps. The permanent or golf bag type shoulder pad, being sewn to the strap, requires that there be a length adjusting mechanism (the loop and buckle type being typical) on both attachment ends of the strap on either side of the shoulder pad so that the shoulder pad can be kept in the middle of the shoulder strap regardless of its overall adjusted length. The molded type shoulder pad has loops which fit snugly around the strap or webbing. It's very difficult, if not impossible, to pull this type of shoulder pad over buckles and swivel hook fittings. In this case, the fittings are sewn to the end of the shoulder strap after the shoulder pad is slipped over the strap.

Some companies sell shoulder strap pads to replace lost or damaged pads. These may be molded or sewn, but likely have relatively large attachment loops because they must accommodate straps of varying widths. Such replacement pads slide along the shoulder straps, easily slip down the shoulder strap, and must be constantly repositioned.

Accordingly, it is an object of the present invention to provide a shoulder pad which can be positioned along the length of the shoulder pad to place it in the proper location regardless of the adjusted length of the strap. There is another object to the invention to provide a shoulder pad construction and attachment means to permit the shoulder pad to be easily slipped over the shoulder strap fittings, such as buckles and swivel hooks, yet grip the shoulder strap to keep it in the proper position for comfort and long wear.

BRIEF DESCRIPTION OF THE INVENTION

Accordingly, a shoulder pad is provided for a shoulder strap for supporting or carrying a luggage case which compromises a generally elongated, rectangular first layer for padding between the strap and the shoulder of the user.

The shoulder pad has a long dimension which extends along in the direction of the strap and a shorter dimension across the direction of the strap. A stretchable band is fixed near opposite edges of the pad across the shorter dimension of the pad. This band comprises a web of elastic cloth.

Further provided is a shoulder pad as set forth above which has opposite edges which extend along the same direction as the length dimension of the strap when in use. The body portion has a front side for contact with the shoulder of the user and a back side, and a means for holding the body portion between the strap and the shoulder of the user. This means for holding comprises a band of stretchable fabric fastened across the back side of the body portion. There is a pair of means for fastening the band at the body portion. This pair of means for fastening is located along the opposite edges of the body portion and spaced from one another a distance about equal to the width dimension of the shoulder strap. The means for fastening comprises a row of stitching passing through the ends of the band of stretchable fabric and through at least the stiffening layer of the body portion of the shoulder pad.

DETAILED DESCRIPTION OF THE PREFERRED EMBODIMENT

The shoulder pad 10 has a means 12 for attaching the main or body portion 14 of the shoulder pad to a luggage strap 16. The luggage strap 16 is typical of other luggage shoulder straps. Since the shoulder pad 10 can slide easily along the entire useful length of the strap 16, the strap 16 needs only a single loop L and a buckle B stitched to the extreme end of the strap webbing for adjusting the overall length of the shoulder pad strap 16. As will be set forth in greater detail, the buckle B can easily be slipped through the fastening means 12 and the body portion 14 to give complete adjustability to the shoulder pad 10.

Figure 1:
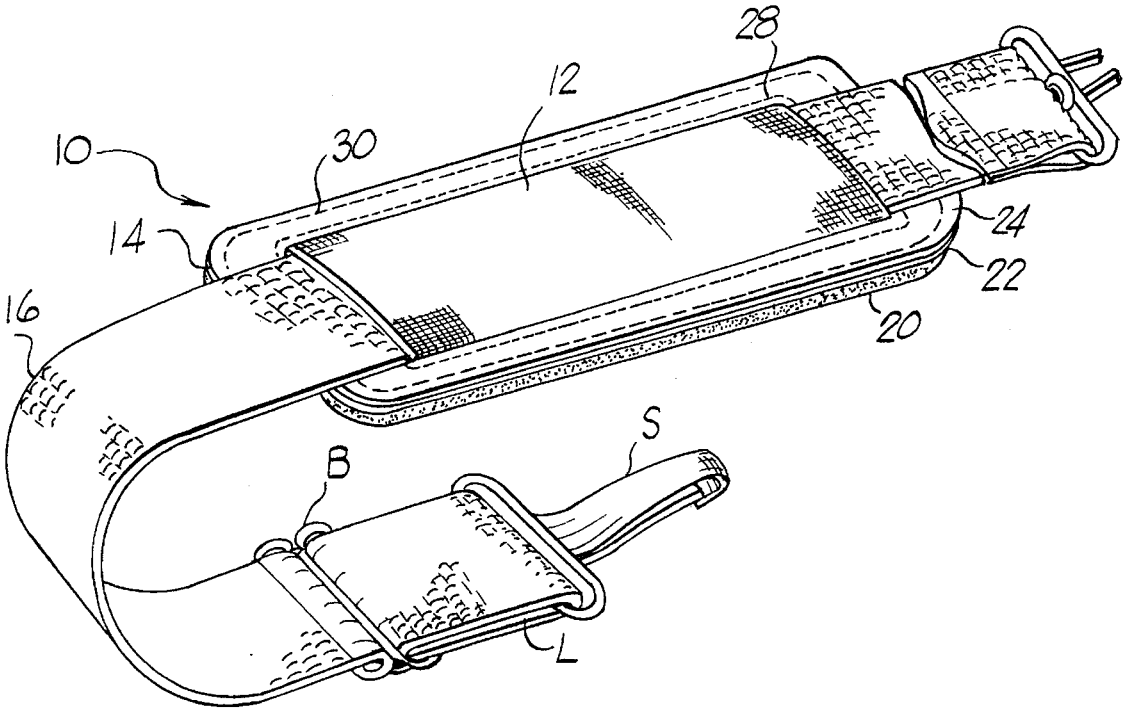
FIG. 1 shows the shoulder pad and shoulder strap in an assembled condition.
Figure 2:
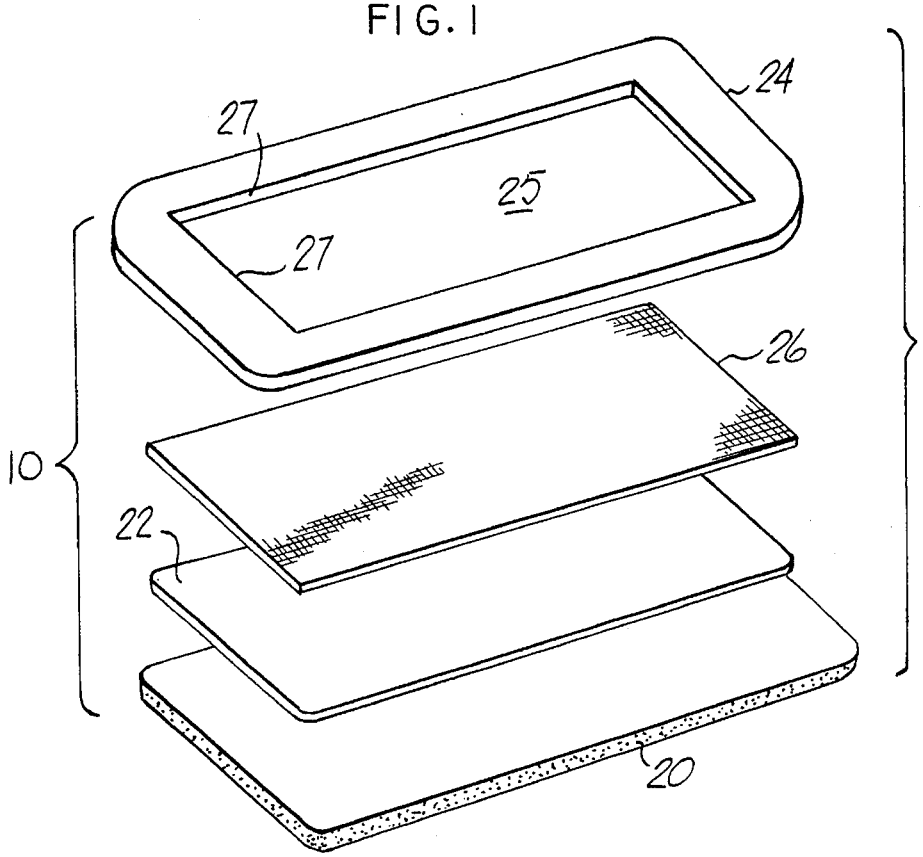
FIG. 2 is an exploded view of the various layers of the shoulder pad shown in FIG. 1.

As seen, the shoulder pad 10 is a generally rectangular shape with an elongated dimension oriented along the length dimension of the strap 16. In FIG. 2, which shows an exploded view of the shoulder pad 10, the main body portion comprises a layer of foam 20. While other shapes are possible, the overall body portion 14 and indeed the foam layer 20 is again generally rectangular in plan. Immediately adjacent to the foam layer 20 is stiffening layer 22. Various materials can be used such as leather, thermoplastic sheeting, etc. However, the preferred material is a conventional flexiblized vinyl-simulated leather. This is used since it is easy to stitch, durable, and can be aesthetically coordinated with the similar vinyl trim of the luggage case to which the shoulder strap is normally attached. The same material choice can be made with regard to the frame 24 which is preferably made from the flexiblized vinyl-simulated leather. An elastic band or web 26 is positioned between frame 24 and the stiffening layer 22. The elastic web is of conventional type. This is a woven material with elastic threads woven into the body of the fabric to give it extreme elasticity in the direction perpendicular to the elongated dimension of the shoulder pad 10. In particular, the elastic webbing material found most desirable for this invention comprises a woven or knit textile material which stretches enough to accommodate and stretch over typical shoulder strap hardware. Here, elastic band 26 has the stretchable dimension extending along the short dimension. The frame 24 has a rectangular aperture 25. As can be seen the long dimension of the aperture 25 corresponds substantially to the long dimension of the elastic webbing 26.

Assembly of the instant shoulder pad is quite easy. A length of elastic webbing is cut to extend across the short dimension of the vinyl frame opening 25. This piece of webbing 26 is positioned on the underneath side of the vinyl frame 24 typically with adhesive tape or hot melt glue to hold it in position. This assembly is then aligned onto a stiffened layer 22 and the foam layer 20. Attachment means comprising stitching 28 around the entire inner perimeter 27 of the frame 24 then used to hold the vinyl frame 24, the elastic webbing 26, and the stiffened layer 22 together as well as hold the longer edges of the elastic webbing in place during use. Finally, this assembly is aligned with a piece of foam padding 20. Final stitching 30 is used to hold all layers together. Note that stitching 30 proceeds around the entire periphery of the thus-assembled shoulder pad. As a last step, the edges of the foam pad are skived and trimmed to give a clean, sculptured look and integrate the entire shoulder pad 10.

Once assembled, the shoulder pad 10 slips easily over a fully assembled and completed adjustable length shoulder strap 16. The elastic webbing 26, since it can stretch a substantial percentage of its width, has no trouble accommodating the buckles B or swivels S. Yet, because of its elasticity, it can grip the relatively narrow shoulder strap portion and thus, not slip easily out of position from the shoulder of the user. The distance between the lateral stitching holding the raw ends of the elastic webbing should be between 85% and 120% of the width dimension of the shoulder strap. In one example, a shoulder pad having an overall width of about 2.75" (from edge to edge of the body portion 14) was prepared for a shoulder strap webbing with a nominal width of 1.50". The aperture in the frame 24 was 1.75" wide and about 6.00" long to accommodate a short length of elastic webbing of nominal width about equal to this 6.00" length. The short length of webbing was positioned in this aperture between the frame 24 and the stiffening layer 22. After this three layer assembly was stitched together by perimeter stitching 28, the length of stitching was trimmed to about 2.25" to place the thus raw cut ends between the long portions of the perimeter stitching on either side of the aperture 25 and the final finish stitching 30 which held the various layers together, including the last applied foam layer 20. In this process, the elastic webbing was given a slight pretensioning prior to applying the stitching 28 so that when placed over the shoulder strap webbing, the elastic webbing pulled the engaged portion of the shoulder webbing into firm contact with the shorter edges of the frame 24 and the underlying exposed surface of the stiffening layer 22.

This shoulder pad was comfortable to the user, stayed in place during use, but could be pulled over the buckle B when necessary. Indeed, even though the buckle B had an overall width of 1.875" and an average thickness of about 0.20" (including the layers of shoulder strap webbing engaged thereby), the elastic webbing stretched to let this assembly pass. Thus, the approximate 1.75" length of elastic web spanning the distance between the attaching stitching 28 stretched about an additional 30% of its length to accommodate this buckle assembly. Even the swivel hooks S used to attach the shoulder strap assembly to the luggage case could be pulled through the inventive shoulder pad without undue force.

The above construction has several operational construction and aesthetic advantages over the prior art. The operational advantages are set forth as above. The assembly advantages have also been outlined, specifically that the shoulder pad can be added to the shoulder strap assembly at any point in the construction, even lending itself to an after market sale to replace the lost or damaged shoulder pads. Aesthetically, the construction has the advantage that the elastic webbing can be made to have a woven in slogan or logo, or this slogan or logo can be added later through embroidery. Contrasting colors can be employed to give a striking appearance. The vinyl frame may be decorative. For example, the frame can be one color and the elastic webbing another color, although a monochrome color scheme complimentary to the luggage case to which the shoulder strap would be attached seems most desirable. Alternate constructions to that shown in the figures are embraced by this invention. For example, the cut of raw ends of the elastic band can be wrapped around the long edges of stiffening layer 22 and stitched in place when layer 22 and foam layer 20 are laminated together by perimeter stitching 30. The portions of 30 along the sides of the strap 16 would be spaced from one another as the corresponding portions of stitching 28.

Of course, multiple bands of elastic material could replace the single band shown, so long as the stretchability and gripping functions are retained.

I claim:

1. A shoulder pad for use with a shoulder strap used to support a luggage case upon a user's shoulder, the pad comprising:

an elongated body portion, the body portion having opposing longitudinal edges extending along a first direction along the length dimension of the strap when in use, the body portion having a bottom side adapted for contact with the user's shoulder;

a decorative layer comprising a frame extending along the longitudinal edges of the body portion and an aperture extending through the decorative layer and defined within the periphery of the frame wherein a bottom side of the decorative layer is disposed adjacent a top side of the body portion such that the aperture is located intermediate the longitudinal edges of the body portion;

means for holding the body portion between the strap and the user's shoulder comprising at least one band of stretchable fabric made from a length of elastic webbing disposed intermediate the body portion and the decorative layer; and means for fastening the decorative layer and the stretchable fabric to the body portion such that the stretchable fabric extends across the aperture, wherein, in use, the strap is serpentined through the aperture and under the layer of stretchable material for holding the body portion to the strap.

2. The shoulder pad as set forth in claim 1 further comprising a stiffening layer disposed between the body portion and the decorative layer wherein the stiffening layer is fastened to the body portion by the fastening means.

3. The shoulder pad as set forth in claim 1 wherein the body portion comprises a foam layer.

4. The shoulder pad as set forth in claim 2 wherein the means for fastening comprising a row of stitching passing through ends of the band of stretchable fabric and through at least the stiffening layer.

5. The shoulder pad as set forth in claim 1 wherein the means for fastening comprising a row of stitching located along each of the longitudinal edges of the body portion wherein each of the rows of stitching are spaced from each other between about 85% to 120% of a width dimension of the strap.

6. The should pad as set forth in claim 3 wherein the row of stitching further passes through the body portion and decorative layer along edges defined by the periphery of the aperture.

* * * * *